US005101999A

United States Patent [19]

Robichaud et al.

[11] Patent Number: 5,101,999

[45] Date of Patent: Apr. 7, 1992

[54] PACKAGE CLOSURE AND PACKAGE PREPARATION

[75] Inventors: Arthur W. Robichaud, Worthington; William B. Peterson, Mt. Vernon, both of Ohio; C. Daniel Miller, Rockford, Ill.

[73] Assignee: Combibloc, Inc., Columbus, Ohio

[21] Appl. No.: 686,814

[22] Filed: Apr. 17, 1991

Related U.S. Application Data

[63] Continuation-in-part of Ser. No. 550,652, Jul. 10, 1990.

[51] Int. Cl.[5] ..... B65D 51/22

[52] U.S. Cl. ..... 220/258; 220/259; 220/267; 229/125.09; 229/125.14

[58] Field of Search ..... 220/260, 258, 259, 267, 220/269, 271, 277, 268; 229/125.09, 125.14

[56] References Cited

U.S. PATENT DOCUMENTS

| | | | |
|---|---|---|---|
| 3,458,080 | 7/1969 | Laurizio | 220/259 X |
| 3,938,693 | 2/1976 | Patel et al. | 220/267 |
| 4,059,201 | 11/1977 | Foster | 220/258 |
| 4,892,217 | 1/1990 | Shastal | 220/258 |
| 4,915,290 | 4/1990 | Robichaud et al. | 220/269 X |
| 4,925,034 | 5/1990 | Robichaud et al. | 220/267 X |
| 4,930,683 | 6/1990 | Farber | 220/258 X |
| 4,934,590 | 6/1990 | Robichaud et al. | 229/125.09 |
| 4,986,465 | 1/1991 | Jacobsson et al. | 220/269 X |

*Primary Examiner*—Stephen Marcus
*Assistant Examiner*—Nova Stucker
*Attorney, Agent, or Firm*—Porter, Wright, Morris & Arthur

[57] ABSTRACT

A closure for opening and resealing a package includes a base attachable to the top of the package over a scored area thereof, and a push tab device pivotally connected to the base at a rearward portion of the base such that a user may depress and end of the push tab into the package thereby creating a central opening area in the package top. The push tab may be provided with a beak and a vent hole. The package top may be partially pre-cut or scored in such a way so as to open in the form of bomb bay doors when the push tab is depressed and rotated into the package. A cover is integrally hinged to the base and is provided for resealing the central opening area.

18 Claims, 6 Drawing Sheets

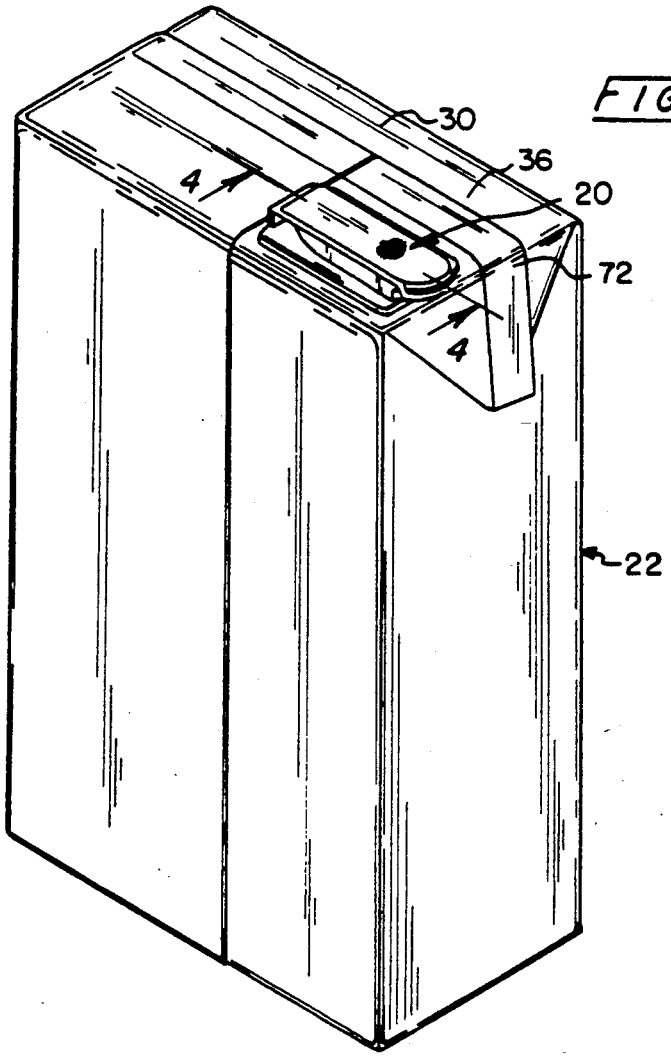
FIG. 1
FIG. 2
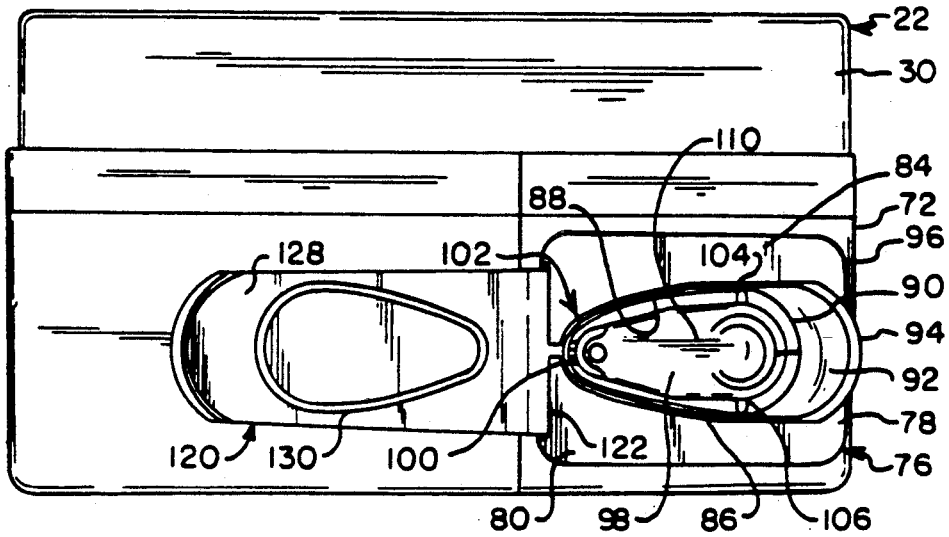

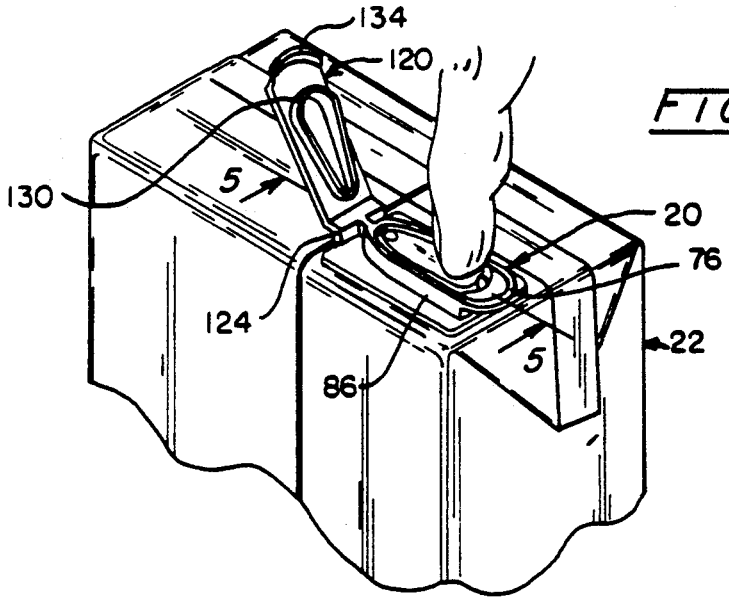
FIG. 3
FIG. 4
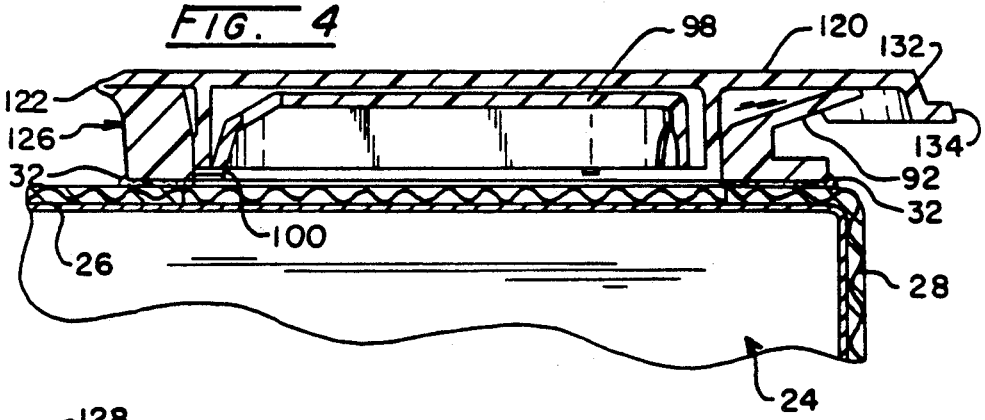
FIG. 5
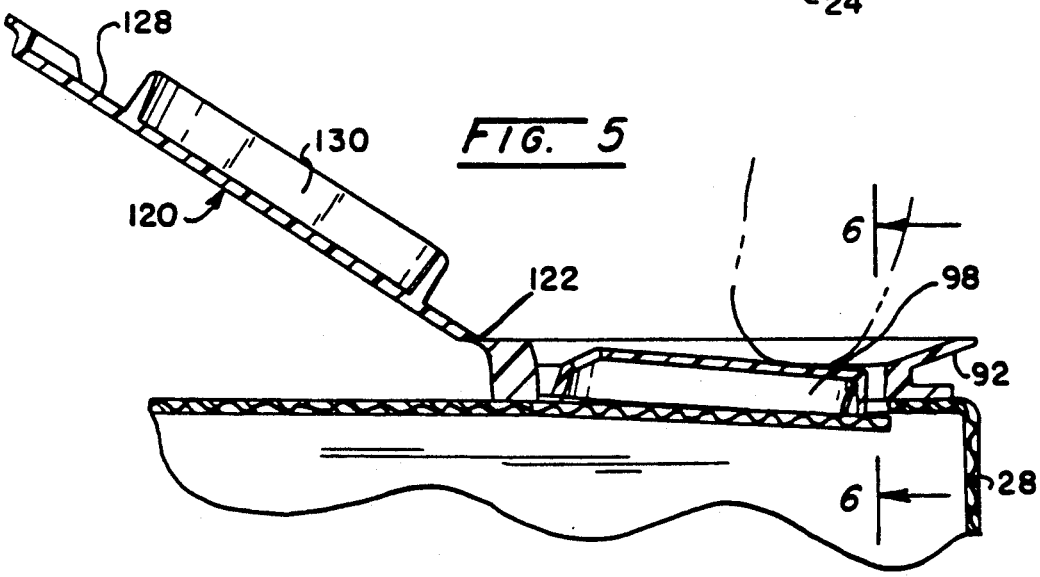

FIG. 6
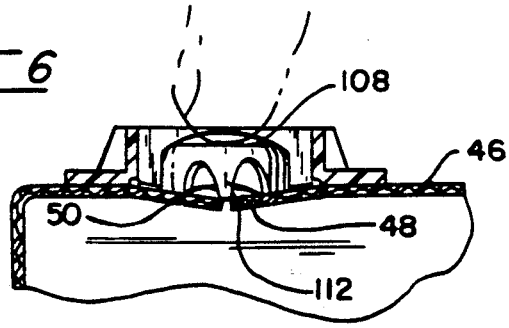
FIG. 7
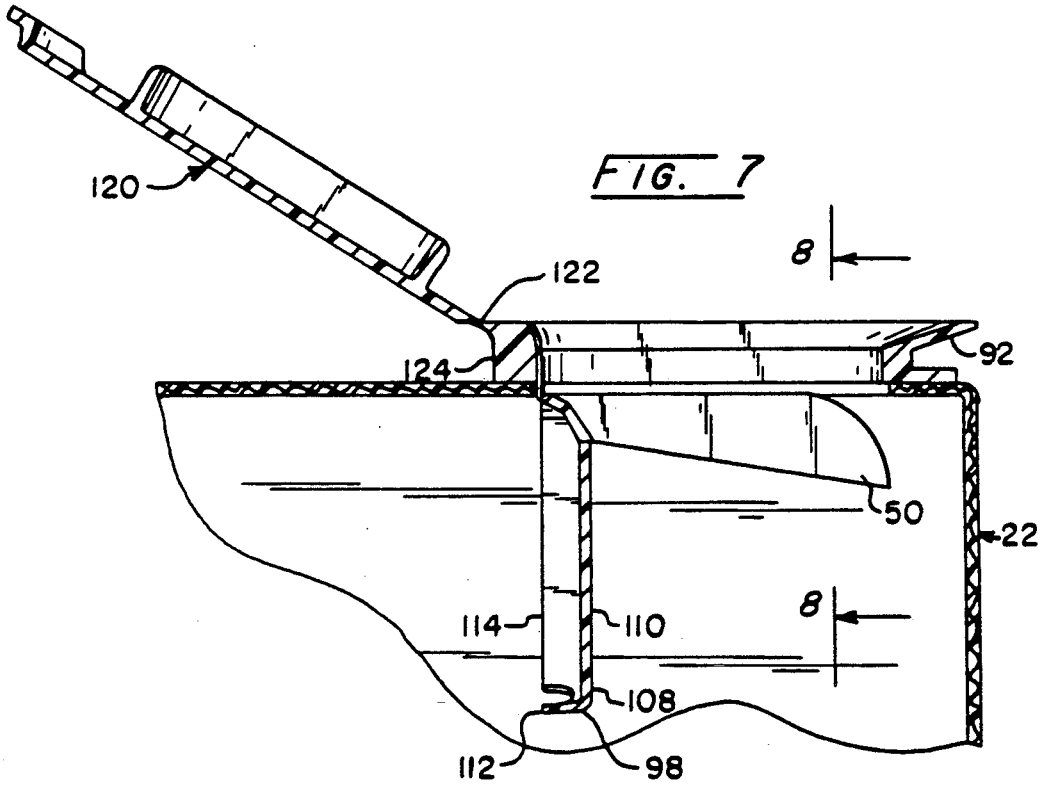
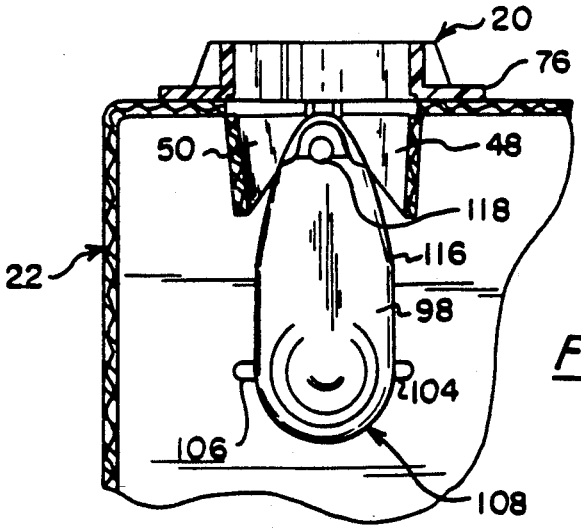
FIG. 8

FIG. 14
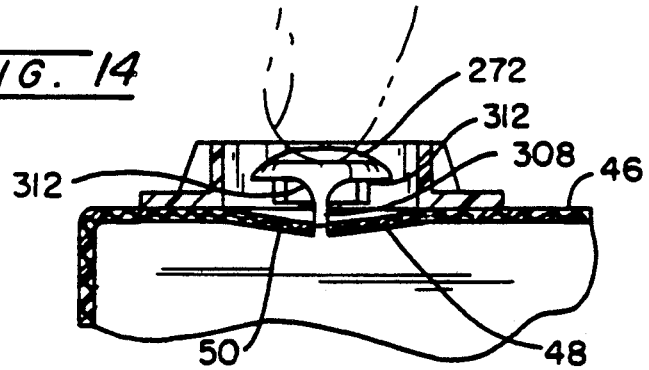
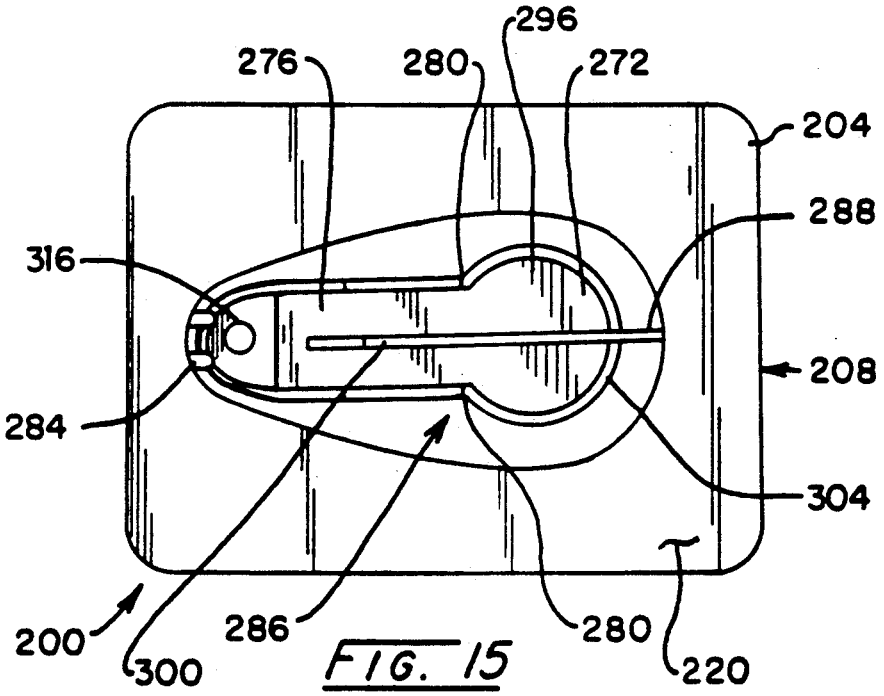
FIG. 15

PACKAGE CLOSURE AND PACKAGE PREPARATION

CROSS REFERENCE TO RELATED APPLICATIONS

This application is a continuation-in-part of U.S. patent application Ser. No. 07/550,652 filed July 10, 1990 titled IMPROVED PACKAGE CLOSURE AND PACKAGE PREPARATION.

FIELD OF THE INVENTION

The present invention relates generally to packages and containers for food and beverages and, more particularly, to closures having package opening and resealing features.

BACKGROUND AND SUMMARY OF THE INVENTION

Paperboard cartons for beverages are generally well known. A familiar type is the milk carton which has a gabled top. More recently, on American grocery store shelves, a different type of paperboard carton has become available primarily for juices. Although used in Europe for many years these aseptic boxes have become popular with children and are known as "juice boxes". The term juice box is somewhat misleading in that the aseptic packages may be used for many other beverages besides juice and even food items such as soups, gravies, and other semi-liquids.

The subject of the present invention is separately attachable closures which provide an alternative means of opening and resealing a package such as a juice box. Generally, a box like package having a flat top is provided with a scored area which can be broken inwardly to open the package. A closure is fitted over the scored area to assist in opening and so that after opening, the package can be resealed to maintain the freshness of the contents thereof.

The assignee of the present invention, Combibloc, Inc. is also the assignee of two previous package closure patents. These patents are: U.S. Pat. Nos. 4,915,290 and 4,934,590 which are both incorporated by reference herein. The '590 Patent is a continuation-in-part of the '290 Patent. The present invention represents various improvements over each of these two patents.

Previous package closure devices have tended to exhibit some common disadvantages. In many of the prior devices a structure of some kind is used to penetrate the top surface of the package thereby pushing a flap of the package top down into the package and away from the newly created opening so as not to spring back and partially obstruct the opening. However, some of the previous devices do not satisfactorily keep the flap from springing back to partially obscure the newly created opening. Another disadvantage of some of the old devices is that upon pouring the fluid out of the box through the newly created opening uneven flow rates result causing fluid to splash through the opening and potentially onto the user causing a mess.

Other disadvantages of the old devices include the inability to make a resealable closure as opposed to a reclosable closure (the difference being that some devices reclose but lack a tight seal to prevent leaks). Still further concerns of the old devices are: too many complicated parts; assembly required; lack of consumer acceptance; durability; ease of use; production costs; and, compatibility with the package.

It is a primary object of the present invention to overcome many of these disadvantages. It is an object of the present invention to provide a closure which is capable of opening a package and then reclosing the package in a resealable fashion. Another object of the present invention is to provide a closure which can be attached to a paperboard package without protruding from the package in such a way as to substantially change the outward geometry of the package. Yet another object of the present invention is to provide a closure which is made substantially as a one piece injection molded plastic unit having a minimum number of movable parts and attachable to a package prior to opening.

Still another object of the present invention is to provide a closure having a built in spout which facilities pouring the contents of a package after opening. Other objects of the present invention are to provide a package closure which is relatively simple in construction and cost effective to produce. It is also an object of the present invention to provide for pouring of the contents of the package at an even flow rate. Yet a further object of the invention is to provide an improved package top preparation over the proposed opening so that when the package top is broken the flap of material does not tend to spring back and partially obscure the newly created opening.

In a preferred embodiment of the present invention, a closure for opening and resealing a package includes a base attachable to the top of the package over a scored area and having a rearward portion and a forward portion. The base may be secured very near a pouring edge of the top. A central open area extending longitudinally between the rearward portion and the forward portion is initially and substantially covered by a substantially rigid push-tab pivotally connected to the rearward portion of the base and having a hinged end and a depressable end. The depressable end is deposed over the central opening area of the base prior to opening the package and is pivotally movable through the central opening area to open the package.

The central opening area may be pre-cut to open in the same manner as bomb bay doors and may be assisted in such opening by a beak forming an integral part of the depressable end of the push-tab. Preferably the hinged end portion of the push-tab includes a vent hole allowing air to enter and resulting in a more even flow rate through a spout formed on a top surface of the base. The spout is formed around at least a forward pouring edge of a raised outer wall surrounding the central opening and a hinged cover is provided on a raised flange of the rearward portion of the base to be rotated over the central opening and to fit tightly thereon to reseal the package.

The foregoing and other objects and advantages will become more apparent when viewed in light of the accompanying drawings and the following descriptions wherein:

BRIEF DESCRIPTION OF THE DRAWINGS

FIG. 1 is a perspective view of the closure attached to the top of a package according to a preferred embodiment of the present invention;

FIG. 2 is a plan view of the closure of FIG. 1 with a cover rotated to its open position;

FIG. 3 is a perspective view of the closure of FIG. 2 showing a user's finger on the depressable end of the push-tab;

FIG. 4 is an enlarged section view taken along line 4—4 in FIG. 1;

FIG. 5 is a section view taken along line 5—5 in FIG. 3 showing the push-tab in its partially open position;

FIG. 6 is a transverse sectional view taken along line 6—6 in FIG. 5 showing the bomb bay doors of the package top starting to open;

FIG. 7 is a side elevational view showing the push-tab in its full open position and the bomb bay doors fully open;

FIG. 8 is a transverse sectional view taken along line 8—8 in FIG. 7;

FIG. 14 is a sectional view taken along line 14—14 in FIG. 13; and

FIG. 15 is a plan view illustrating the bottom surface of the closure as shown in FIG. 11.

DETAILED DESCRIPTION OF THE PREFERRED EMBODIMENT(S)

Figure 9:
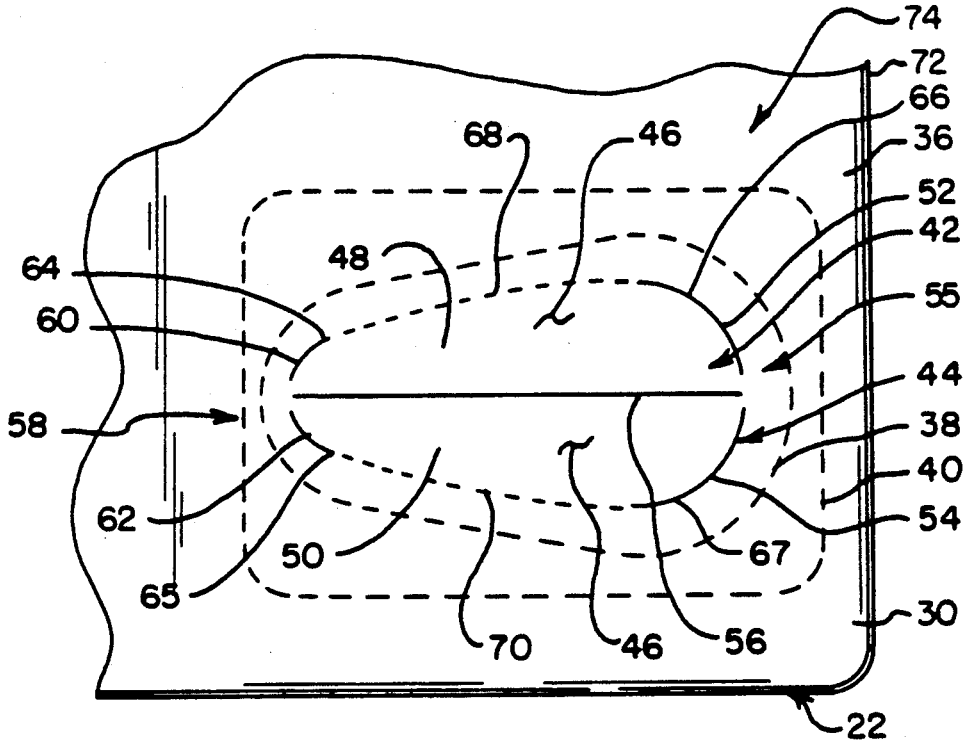
FIG. 9 is a partial plan view of the package top surface showing the scored area.

Referring to FIG. 1 a closure 20 for opening and resealing a package 22 is provided. The package 22 is a box-like paperboard package which may contain a dispensable fluid, powder, or particulate solid substance. The package 22 may be manufactured from laminated material which is somewhat flexible and tough making it difficult to penetrate.

The package 22 may be an aseptic type meaning that it has a sterile inner space 24 which is delimited by an unbroken barrier layer 26 as shown in FIG. 4. The closure 20 is intended to be applied to the outside of the packing laminate after forming and filling the package 22. The closure is designed to allow opening of the package 22 without its barrier layer 26 having been broken or weakened in advance. The closure 20 of the present invention is particularly suitable for packages that are manufactured from a laminate comprising a carrier layer 28 of fibrous material, e.g. paper, which is covered on both sides by homogenious layers of thermoplastic material.

Furthermore, on the side of the package 22 facing the contents a barrier layer 26 of foil along with a possible sealant layer of thermoplastic material facing the contents of the package 22 may be provided. To facilitate the penetration of the material upon opening the package closure 20, the carrier (paper) layer 28 and possibly the outer thermoplastic layer can be wholly or partly penetrated while maintaining the barrier layer 26 integrity unbroken, hence maintaining package 22 sterility.

The package closure 20 is attached to the package top 30 by any suitable means such as an adhesive 32 applied to a bottom surface 34 of the closure 20 to be attached to the package top 30. If adhesives 32 are used consider that the carrier or paper layer 28 of the package 22 may be coated with an outer thermoplastic layer of polyethylene 36. The polyethylene outer layer 36 discourages adhesion. To compensate for this, first and second perimeter cuts 38, 40 may be made in the package top 30 region surrounding a central opening area 42 as shown in FIG. 9. The first and second perimeter cuts 38, 40 may be serrated or perforated cuts which need only penetrate the polyethylene outer layer 36 to allow the adhesive 32 to bond with the underlying carrier or paper layer 28. To further prepare the package top 30 for penetration upon opening, a series of half cuts 44 may be made in conjunction with the central opening area 42. These half cuts 44 may be to a depth through the package layers down to, but not penetrating, the barrier layer 26.

To prevent package material 46 from springing back up to partially obscure the central opening area 42 once the package 22 has been opened the half cuts 44 are designed to provide bomb bay doors 48, 50 (reminiscent of the apparatus of the same name on military aircraft) in the package top 30 opening 42. To accomplish the bomb bay doors 48, 50 first and second arc cuts 52, 54 may be provided at the forward end region 55 of the central opening area 42. Passing between the arc cuts 52, 54 and running longitudinally along the central opening area 42 of the package top 30 material is a middle cut 56. At the rear end portion 58 of the central opening area 42 first and second notch cuts 60, 62 may be made flanking the middle cut 56. Between the outer ends 64, 66 of the first notch cut 60 and the first arc cut 52 and the second notch cut 62 and the outer ends 65, 67 of the second arc cut 54 first and second serrated cuts 68, 70 respectively may be provided and function to allow the bomb bay doors 48, 50 formed from the package material to swing (hinge) open and at the same time prevent the doors 48, 50 from separating entirely from the package 22 and falling into the contents of the package 22.

Figure 10:
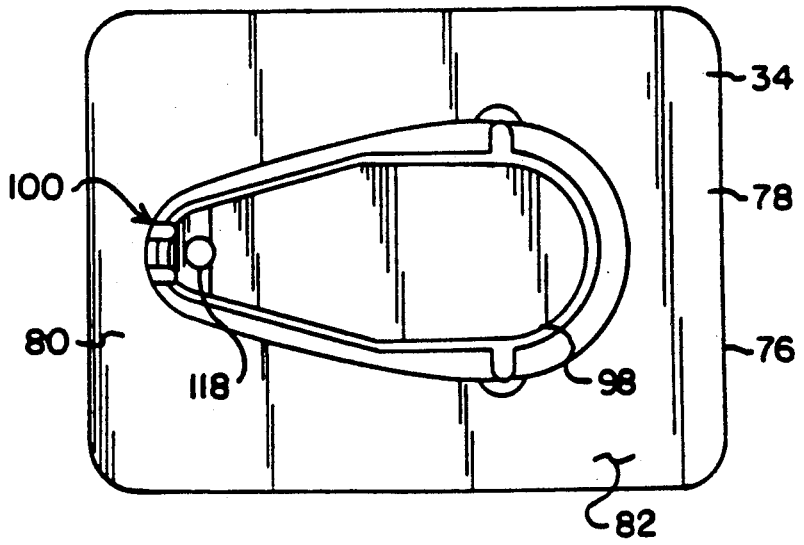
FIG. 10 is a plan view showing the bottom surface of the closure.
Figure 11:
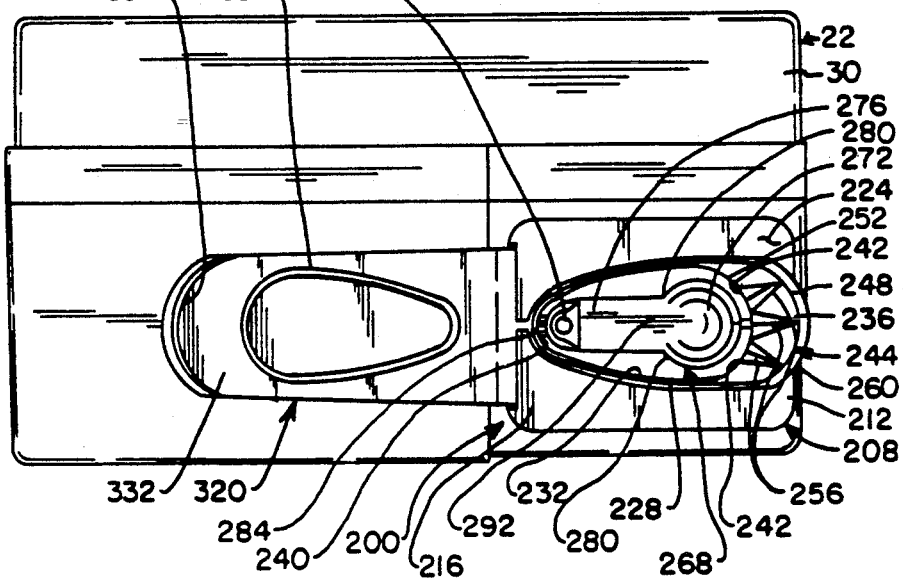
FIG. 11 is a plan view of an alternative embodiment of the closure with a cover in its open position.
Figure 12:
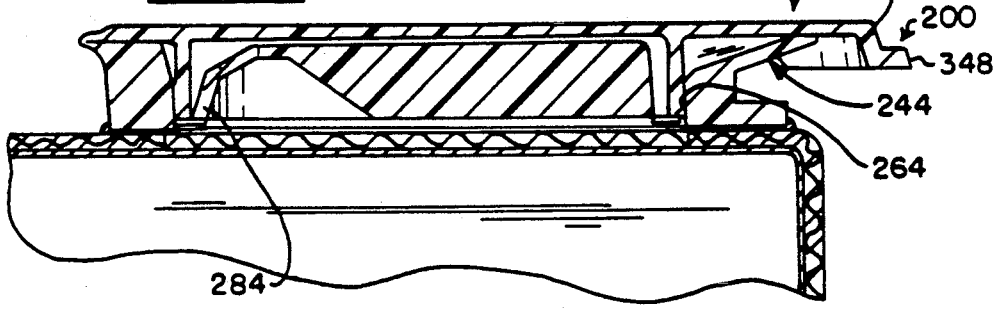
FIG. 12 is an enlarged, sectional view of the alternative embodiment with a cover in its closed position, taken along a line through the center of the closure. This Figure corresponds to FIG. 4 of the preferred embodiment.
Figure 13:
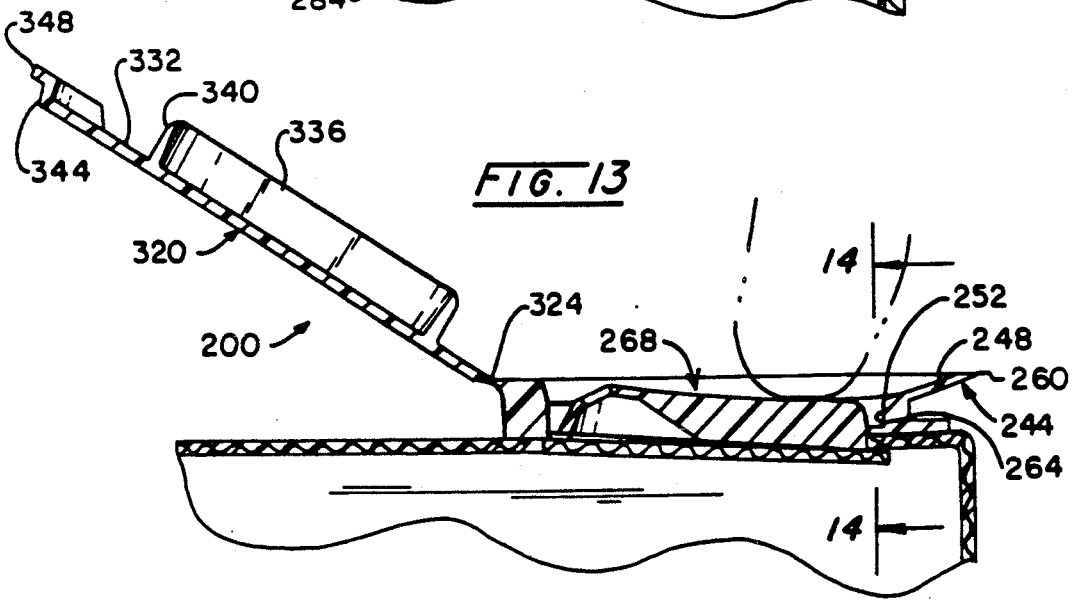
FIG. 13 is a sectional view of the alternative embodiment with a cover in its open position, taken along a line through the center of the base portion of the closure. This Figure corresponds to FIG. 5 of the preferred embodiment.

The package closure 20 is secured to the package top 30 near a front edge 72 of the package 22 and over the scored area 74 surrounding the central opening area 42. The closure 20 has a base 76 that may be of a substantially rectangular shape having a forward portion 78 and a rearward portion 80. A bottom surface 82 of the base 76 as shown in FIG. 10 is secured to a top surface 30 of the package 22 by using adhesive 32, for example.

On a top surface 84 of the base 76 as shown in FIGS. 2 and 3 there is formed a raised outer wall 86. Interiorally of the raised wall 86 there is formed a curved inner side wall 88 which at its forward end 90 begins an incline forming a spout 92. A preferred angle of inclination for the spout 92 may be approximately 10°-20°. A pouring edge 94 of the spout 92 may extend just slightly past the forward edge 96 of the base 76.

FIGS. 5-8 show the manner in which the package 22 is opened. In these figures the barrier layer 26 is not shown for reasons of clarity. A push-tab 98 is formed to initially reside within the inner side wall 88 of the spout 92 and directly over the central opening area 42. The push-tab 98 has a hinged end 100 connected to a rear portion 102 of the inner side wall 88 and may have first and second frangible connections 104, 106 on either side of a depressable end 108 of the push-tab 98 and initially attached to the inner side wall 88. The push tab 98 comprises an upper push surface 110 for the user to exert pressure thereon causing the first and second frangible connections 104, 106 to break, resulting in the depressable end 108 of the push tab 98 rotating down into the package 22 while the hinged end 100 of the push tab 98 remains secured to the inner sidewall 88.

To facilitate the opening of the package top 30 material 46 as the push tab 98 is depressed, a substantially pointed beak 112 may be provided on an under side 114 of the depressable end 108 of the push tab 98 to assist in penetrating the middle cut 56 of the package top 30 material 46. As the push tab 98 is depressed the beak 112 will contact the middle cut 56 which starts the middle cut 56 to split. As the push tab 98 is further depressed it will continue to separate the package material 46 via the middle cut 56 resulting in the package material 46 splitting into two bomb bay doors 48, 50.

As a result of the combination effects of the push tab 98 contour 116 and the bomb bay doors 48, 50 the bomb bay doors 48, 50 will stay out away from the central opening area 42 due to the push-tab 98 being positioned between the doors 48,50. The doors 48,50 will also act to keep the push tab 98 extended down and away from the central opening area 42 by exerting a force inward against the push-tab 98. A rear vent hole 118 may be provided in the push tab 98 to allow air to enter the package 22 in a region behind the push-tab 98 as the contents of the package 22 is poured. This will result in a more even flow rate of the package contents.

After the package 22 is opened, the user may desire to reseal any remaining, unused contents. To accomplish this resealing of the closure 20, a cover 120 is provided. The cover 120 may be formed from the same piece of material as the base 76 and may be integrally hinged to the base 76 via a crease 122 formed at a top edge of a raised flange 124. The raised flange 124 may be formed at the rear edge 126 of the top surface 84 of the base 76.

On an inner planar surface 128 of the cover 120, a raised lip 130 may be provided to form a part in the resealing means. An interference fit between the lip 130 and the inner sidewall 88 of the spout 92 offers a complementary sealing means. A rounded leading edge 132 of the cover 120 may be provided to fit over and conceal the spout 92. Additionally, a step 134 on the rounded leading edge 132 may be provided to offer additional surface area for a user's finger to contact while lifting the cover 120 off the spout 92 when opening the package 22. The entire package closure 20 may be formed in one mold in an injection molding machine as would be known to one of skill in the art.

An alternative embodiment of the closure 20 is illustrated in FIGS. 11–15. Where appropriate, like components have been given like reference numbers.

The closure 200 illustrated in FIGS. 11–15 is useful for opening and resealing a package 22 in a manner similar to closure 20 illustrated in FIGS. 1–10. Closure 200 has a bottom surface 204 which is attached to a package top 30 in any suitable manner, including that described in connection with closure 20.

The closure 200 includes a base portion 208 which is substantially rectangular in shape having a forward portion 212 and a rearward portion 216. The base portion 208 includes a bottom surface 220 which is secured to the top surface 30 of a package 22 by various suitable means, including an adhesive. The base portion 208 further includes a top surface 224 containing a raised wall 228. The wall 228 has an interior side wall 232 having sides 234 forming a forward end 236 and rearward end 240. The interior side wall 232 includes projections 242, the purpose of which will be explained later in greater detail. The forward end 236 of the interior side wall 232 defines a spout 244 having a forward edge 248 and a rearward edge 252. The spout 244 preferably has an angle of inclination of 10°–20° and more preferably has an angle of inclination of about 15°. The spout 244 contains indentations 256 which act to help break up any bubbles which form on the spout 244 and which allow for improved flow of the fluid, etc. back into the package 22. The forward edge 248 of the spout 244 may include a pouring edge 260 which may extend beyond the forward portion 212 of the base portion 208. The spout 244 tapers from the forward edge 248 to the rearward edge 252 and the rearward edge 252 terminates at a face 264 which is square to the rearward edge 252.

A push-tab 268 is formed to initially reside within the interior side wall 232 directly over the central opening area 42 of the package top 30. The push-tab 268 has a forward or depressable portion 272 having a front end 274 and a rearward portion 276 where the rearward portion 276 is narrower than the forward portion 272 and an indentation 280 is formed where the rearward portion 276 meets the forward portion 272. The rearward portion 276 of the push-tab 268 has a hinged end 284 connected to the rearward end 240 of the interior side wall 232. A security tie 288 is connected to the forward portion 272 of the push-tab 268 and is initially attached to the interior side wall 232. The push-tab 268 includes an upper or push surface 292 which is pressed by the user causing the security tie 288 to break, resulting in the forward portion 272 of the push-tab 268 rotating down into the package 22 while the rearward portion 276 of the push-tab 268 remains secured to the interior side wall 232. The security tie 288 is preferably molded such that it will remain intact with the push-tab 268 when the push-tab 268 is pushed through the package top 30.

To facilitate the opening of the package top 30 and package material 46, the push-tab 268 has a bottom surface 296 which includes a blade 300 extending from the front end 274 of the forward portion 272 to the rearward portion 276. The bottom surface 296 includes an outer periphery 304 which forms a beak 308 that intersects with the blade 300 near the front end 274 of the forward portion 272 of the bottom surface 296 of the push tab 268. The outer periphery 304 forms a radius 312 on either side of the beak 308 to further facilitate the opening of the package top 30.

As the push-tab 268 is depressed under this construction, the beak 308 initially contacts the package material 46 causing the package material 46 to split. As the push-tab 268 is depressed further, the blade 300 contacts the package material 46 and eventually pushes through the package material causing the package material 46 and package top 30 to split into two bomb bay doors 48 and 50.

After the push-tab 268 has been pressed through the package material 46 and the two bomb bay doors 48 and 50 have been formed, the bomb bay doors 48 and 50 will stay clear of the central opening area 42 and will be locked in place by the push-tab 268. The bomb bay doors 48 and 50 are positioned on either side of the push-tab 268 and rest in the indentations 280 between the forward portion 272 and the rearward portion 276 f the push-tab 268 and exert a force against the push-tab 268 to help keep the push tab 268 extending down and away from the central opening area 42. A vent hole 316 may be provided in the rearward portion 276 of the push tab 268 to allow air to enter the package 22 in a region behind the push-tab 268 as the contents inside the package are poured. This will allow for a more even flow rate of the contents from the package 22.

The closure 200 further includes a cover 320 which is used to seal the closure 200 after the package 22 has been opened. The cover 320 may be formed separately from the base portion 208 of the closure 200, but the cover is preferably integrally connected to the base portion 208 by a hinge 324 formed at the rearward portion 216 of the base portion 208.

The cover 320 includes an inner planar surface 332 having a forward end 334 and a raised lip 336 extending from the inner planar surface 332. The raised lip 336 includes a circumferential seal 340 which performs a resealing function as it provides an interference fit with the interior side wall 232 of wall 228.

As the cover 320 is closed, the seal 340 surrounding the raised lip 336 initially contacts the projections 242 on the interior side wall 232 of wall 228. As the seal 340 is pushed past the projections 242, the closure 200 will make an audible "snap" sound which helps the user to understand that the closure 200 is resealed. Additionally, once the seal 340 is pushed past the projections 242, the projections 242 assist in locking the cover 320 in place over the base portion 208.

The cover 320 further includes a leading edge 344 extending from the forward end 334 of the inner planar surface 332. This leading edge 344 is provided to conceal the spout 244 when the cover 320 is closed and may include a step 348 to provide additional surface area for the user's finger to contact when lifting the cover 320 off the spout 244 when opening the package 22.

The many features and advantages of the present invention are apparent from the detailed specification, and thus, it is intended by the appended claims to cover all such features and advantages of the resealable package closure, which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to falling within the scope and the spirit of the invention.

What is claimed is:

1. A package closure device secured to a package for opening and resealing the package, the package having contents therein, said device comprising:

a base having a central opening defined by an inner side wall formed integrally of said base;

a cover hinged to said base, said cover rotatable over said central opening; and a push tab pivotally connected to said side wall defining said central opening, said push tab pivotal independently of said cover said push tab to pierce said package when pressure is exerted on a depressable end top surface of said push tab.

2. The package closure device of claim 1 wherein said package is aseptic.

3. The cover of the package closure device of claim 1, further comprising:

resealing means forming a part of said cover to seal said central opening when said cover is rotated over said central opening and lies atop said base.

4. The cover of claim 3, wherein said resealing means comprises a raised lip on an inner planar surface of said cover, said lip of a size and shape capable of forming an interference fit inside said inner sidewall that forms said central opening in said base.

5. The package closure device of claim 1, further comprising:

a spout integrally formed on said base at a pouring edge of said inner sidewall.

6. The package closure device of claim 1, further comprising:

means for facilitating a substantially even flow rate as the contents of said package is poured through said central opening.

7. The package closure device of claim 6, wherein said means for facilitating a substantially even flow rate includes an air vent in said push-tab.

8. The package closure device of claim 1 wherein said push-tab includes a bottom surface and wherein said bottom surface includes a blade to penetrate said package.

9. The package closure device of claim 4 wherein said inner sidewall include projections and wherein said raised lip includes a circumferential seal, said seal formed to contact said projections when said cover is rotated over said central opening.

10. The package course device of claim 5 wherein said spout contains an indentation.

11. In a resealable package, the combination comprising:

a scored portion in a surface of said package, said scored portion including a plurality of half cuts in said package surface, said half cuts forming the means by which package material forming a central opening area will open into bomb bay doors;

a package closure device secured to said package surface substantially over said scored portion, said package closure device including a base having a central opening defined by an inner sidewall formed integrally of said base, a push-tab pivotally connected at an end of said sidewall defining said central opening, said push tab including a substantially pointed beak on an end of said push-tab opposite said pivot connection, said beak to pierce said package material at the location of said half cuts when pressure is exerted on a depressable end top surface of said push-tab, said push-tab further including air control means for maintaining a substantially constant flow rate as contents of said package is poured through said central opening;

a cover hinged to an end of said base, said cover rotatable over said central opening; and resealing means forming a part of said cover to seal said central opening when said cover is rotated over said central opening and lies atop said base.

12. A package closure device comprising:

a base portion including a bottom surface adapted to be secured to a package, said base portion further including a top surface, said top surface including a raised wall defining a central opening area;

push-tab means pivotally attached to said wall, said push-tab means having a bottom surface, said bottom surface including means for piercing said package when pressure is exerted on said push-tab means; and cover means independently pivotal from said push-tab means, said cover means including a raised surface projecting from said cover means, said raised surface formed to contact said raised wall and close said central opening area.

13. The package closure device of claim 12 wherein said cover means is pivotally attached to said base portion.

14. The package closure device of claim 12 wherein said raised wall defines an interior side wall, said interior side wall having projections thereon, and wherein said raised surface projecting from said cover means includes said means thereon such that said means contacts said projections when said cover is placed over said central opening area.

15. The package closure device of claim 14 wherein said interior side wall has an end and said interior side wall defines a spout at said end.

16. The package closure device of claim 15 wherein said spout contains indentations.

17. The package closure devise of claim 12 wherein said piercing means includes a beak opposite said pivotal attachment and further includes blade means extending from said beak.

18. The package closure device of claim 12 further comprising security tie means extending from said push-tab means to said base portion.

* * * * *